US011332987B2

(12) United States Patent
Teixeira et al.

(10) Patent No.: US 11,332,987 B2
(45) Date of Patent: May 17, 2022

(54) SAFE DYNAMIC HANDOVER BETWEEN MANAGED PRESSURE DRILLING AND WELL CONTROL

(71) Applicant: SafeKick Americas LLC, Katy, TX (US)

(72) Inventors: Mario Ledes Mascarenhas Resende Teixeira, Reading (GB); Helio Mauricio Ribeiro dos Santos, Reading (GB)

(73) Assignee: SAFEKICK AMERICAS LLC, Katy, TX (US)

( * ) Notice: Subject to any disclaimer, the term of this patent is extended or adjusted under 35 U.S.C. 154(b) by 149 days.

(21) Appl. No.: 16/871,466

(22) Filed: May 11, 2020

(65) Prior Publication Data

US 2021/0348461 A1 Nov. 11, 2021

(51) Int. Cl.
*E21B 21/08* (2006.01)
*E21B 34/02* (2006.01)
(Continued)

(52) U.S. Cl.
CPC ..... *E21B 21/08* (2013.01); *E21B 21/001* (2013.01); *E21B 33/063* (2013.01);
(Continued)

(58) Field of Classification Search
CPC ..... E21B 19/00; E21B 21/001; E21B 21/08; E21B 33/063; E21B 34/025; E21B 47/001; E21B 47/06
See application file for complete search history.

(56) References Cited

U.S. PATENT DOCUMENTS 8,528,660 B2 9/2013 Santos
9,175,531 B2 11/2015 Santos et al.
(Continued)

FOREIGN PATENT DOCUMENTS

WO 2016062314 A1 4/2016
WO 2019118394 A1 6/2019
WO WO-2020231996 A1 * 11/2020 ..... E21B 21/001

OTHER PUBLICATIONS

PCT International Search Report of International Search Authority (USPTO) for PCT/US2021/027136, filed on Apr. 13, 2021, dated Jul. 7, 2021.
(Continued)

*Primary Examiner* — Matthew R Buck
(74) *Attorney, Agent, or Firm* — Basil M. Angelo; Angelo IP

(57) ABSTRACT

Safe dynamic handover between MPD and well control operations provides the ability to automate MPD, well control, and transitions therebetween while maintaining the wellbore in a dynamic fluid state at all times. In the event a kick is taken, a safe dynamic handover from MPD to well control operations is made, unknown formation fluids within the wellbore are circulated out of the wellbore, and a safe dynamic handover from well control operations to MPD is made while maintaining the wellbore in dynamic fluid state, without ever going static with respect to fluids within the wellbore. Because the wellbore remains dynamic, the formation of gels is prevented, thereby preventing pressure spikes during the start-up of the mud pumps and improving pressure transmission throughout the well system. Pressure may be more precisely managed during all phases of MPD, well control, and transitions therebetween.

32 Claims, 3 Drawing Sheets

(51) Int. Cl.

| | |
|---|---|
| ***E21B 33/06*** | (2006.01) |
| ***E21B 47/001*** | (2012.01) |
| ***E21B 21/00*** | (2006.01) |
| ***E21B 47/06*** | (2012.01) |
| *E21B 19/00* | (2006.01) |

(52) U.S. Cl.
CPC ..... *E21B 34/025* (2020.05); *E21B 47/001* (2020.05); *E21B 47/06* (2013.01); *E21B 19/00* (2013.01)

(56) References Cited

U.S. PATENT DOCUMENTS

| | | | | |
|---|---|---|---|---|
| 10,648,259 | B2 | 5/2020 | Santos et al. | |
| 2013/0220600 | A1* | 8/2013 | Bakri | E21B 21/08 166/250.01 |
| 2018/0171775 | A1 | 6/2018 | Santos | |
| 2019/0145202 | A1* | 5/2019 | Vavik | E21B 21/08 175/25 |
| 2019/0226290 | A1 | 7/2019 | Santos | |

OTHER PUBLICATIONS

PCT Written Opinion of International Search Authority (USPTO) for PCT/US2021/027136, filed on Apr. 13, 2021, dated Jul. 7, 2021.

* cited by examiner

SAFE DYNAMIC HANDOVER BETWEEN MANAGED PRESSURE DRILLING AND WELL CONTROL

BACKGROUND OF THE INVENTION

Managed Pressure Drilling ("MPD") techniques seek to manage pressure during drilling and other operations through the controlled application of surface backpressure. Typically, an annular sealing system is used to controllably seal the annulus surrounding the drillstring and surface backpressure is controllably applied by manipulating the choke aperture setting, sometimes referred to as the choke position, of one or more choke valves of an MPD choke manifold disposed on the drilling rig. The MPD choke manifold is fluidly connected to one or more flow lines that divert returning fluids from, or below, the annular seal to the surface. Each choke valve is capable of a fully opened state where flow is unimpeded, a fully closed state where flow is stopped, and a number of intermediate states where flow is at least partially restricted. In this way, if the pressure in the annulus falls below a lower threshold, one or more choke valves of the MPD choke manifold may be closed to the extent necessary to increase the annular pressure the requisite amount. Similarly, if the pressure in the annulus rises above an upper threshold, one or more choke valves of the MPD choke manifold may be opened to the extent necessary to decrease the annular pressure the requisite amount. In practice, MPD systems are used in one of several modes of operation. In surface backpressure mode, surface backpressure at the MPD choke manifold is managed directly. In bottomhole pressure mode, a hydraulic model is used to calculate a pressure that will achieve a desired pressure at depth based on models, real-time data, and the operation being conducted. Regardless of the mode of operation, the means by which pressure is managed is the manipulation of one or more choke valves of the MPD choke manifold.

During certain drilling operations, MPD may be used to maintain well control by managing wellbore pressure within a safe pressure gradient bounded by the pore pressure and the fracture pressure, where the collapse pressure is sometimes used in place of the pore pressure if it is higher than the pore pressure. In this context, well control generally refers to techniques used to manage the hydrostatic and formation pressure to prevent the unintended influx of unknown formation fluids into the well system. If the pressure in the annulus falls below the pore pressure, unknown formation fluids may flow into the wellbore and well control may be lost. The unintentional influx of unknown formation fluids into the wellbore is commonly referred to as a kick. Kicks are inherently dangerous because the unknown formation fluids may contain explosive gas that increases the risk of a dangerous blowout. Similarly, if the pressure in the annulus rises above the fracture pressure, the formation may hydraulically fracture or crack such that drilling fluids are lost to the formation and, if the fluid level within the wellbore decreases to the extent that wellbore pressure falls below the pore pressure, then a kick may be taken and well control may be lost. As such, standard industry practices seek to maintain well control during drilling and other operations by carefully navigating the safe pressure gradient. However, geological uncertainties, imperfect information, and constantly changing conditions sometimes give rise to unexpected contingencies and it is critically important to have the capability to take appropriate actions when a kick is taken. As such, once a kick is taken, if the volume of the kick and the additional pressure required to kill the well exceeds a predetermined operational limit, MPD operations are stopped and well control operations are manually performed to circulate out the unknown formation fluids in the well system to restore well control such that drilling operations may safely resume.

BRIEF SUMMARY OF THE INVENTION

According to one aspect of one or more embodiments of the present invention, a method of safe dynamic handover between managed pressure drilling and well control includes setting a pressure setpoint of an MPD choke manifold to a surface backpressure setpoint and setting a pressure setpoint of an automated well control choke manifold to a sensed pressure taken from below a blowout preventer or a kill line pressure of the blowout preventer. A pressure imbalance is created by setting the pressure setpoint of the MPD choke manifold above the pressure setpoint of the automated well control choke manifold by a predetermined amount. The pressure imbalance automatically causes an MPD control system to close the MPD choke manifold as the well control control system opens the automated well control choke manifold. The method further includes verifying that the sensed pressure or kill line pressure increases until the automated well control choke manifold opens enough such that the blowout preventer pressure or kill line pressure remains constant, closing an annular of the blowout preventer after the MPD choke manifold is closed, and diverting unknown formation fluids from the choke line of the blowout preventer to the automated well control choke manifold for delivery to a mud-gas-separator. The wellbore remains fluidly dynamic due to continuous injection of drilling fluids.

According to one aspect of one or more embodiments of the present invention, a non-transitory computer-readable medium comprising software instructions that, when executed by a processor, perform a method of safe dynamic handover between managed pressure drilling and well control that includes setting a pressure setpoint of an MPD choke manifold to a surface backpressure setpoint and setting a pressure setpoint of an automated well control choke manifold to a sensed pressure taken from below a blowout preventer or a kill line pressure of the blowout preventer. A pressure imbalance is created by setting the pressure setpoint of the MPD choke manifold above the pressure setpoint of the automated well control choke manifold by a predetermined amount. The pressure imbalance automatically causes an MPD control system to close the MPD choke manifold as the well control control system opens the automated well control choke manifold. The method further includes verifying that the sensed pressure or kill line pressure increases until the automated well control choke manifold opens enough such that the blowout preventer pressure or kill line pressure remains constant, closing an annular of the blowout preventer after the MPD choke manifold is closed, and diverting unknown formation fluids from the choke line of the blowout preventer to the automated well control choke manifold for delivery to a mud-gas-separator. The wellbore remains fluidly dynamic due to continuous injection of drilling fluids.

According to one aspect of one or more embodiments of the present invention, a system for safe dynamic handover between managed pressure drilling and well control includes an annular sealing system capable of controllably sealing an annulus surrounding a drillstring forming an MPD annular seal, a blowout preventer capable of controllably sealing an annulus surrounding the drillstring forming a well control annular seal, an MPD choke manifold comprising a plurality of choke valves with at least one choke valve in fluid communication with a flow line capable of diverting returning fluids from or below the MPD annular seal to a fluids processing system, an automated well control choke manifold comprising a plurality of choke valves with at least one choke valve in fluid communication with a choke line capable of diverting returning fluids from or below the well control annular seal to a mud-gas separator, and a well control control system that automates the settings of the automated well control choke manifold during handovers between managed pressure drilling and well control operations to maintain the wellbore in a dynamic fluid state.

Other aspects of the present invention will be apparent from the following description and claims.

DETAILED DESCRIPTION OF THE INVENTION

Figure 1:
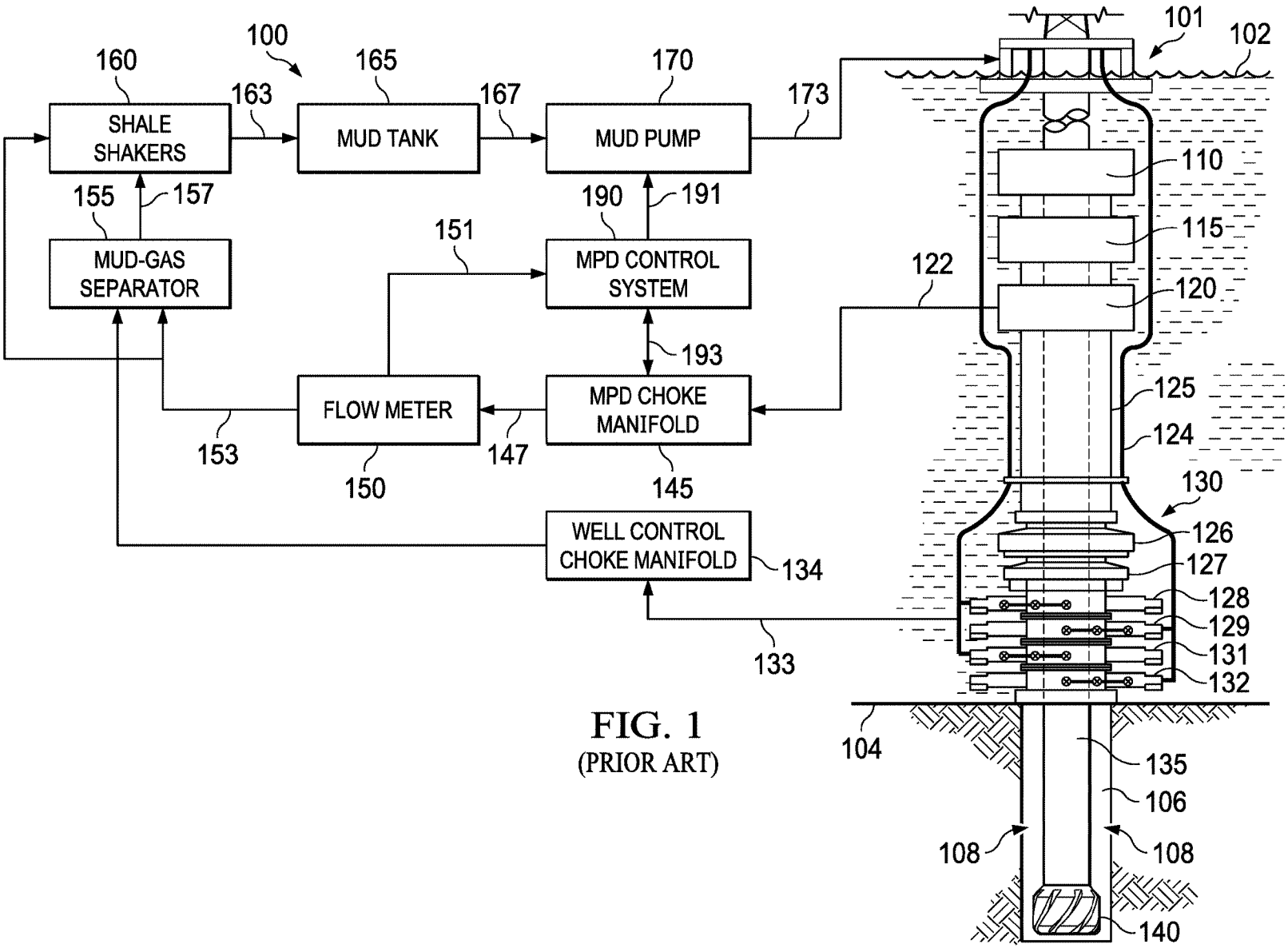
FIG. 1 (PRIOR ART)
FIG. 1 shows a conventional closed-loop hydraulic drilling system for managed pressure drilling and conventional well control operations.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention. For purposes of clarity, for wellbore components described herein, top or upper refer to a portion or side that is closer, whether directly or in reference to another component, to the surface above the wellbore and bottom or lower refer to a portion or side that is closer, whether directly or in reference to another component, to the bottom of the wellbore.

FIG. 1 shows a conventional closed-loop hydraulic drilling system 100 for MPD and conventional well control operations. For the purposes of illustration, a drilling system 100 for offshore drilling operations is shown. While offshore applications require additional components such as, for example, a marine riser system, to facilitate drilling a subsea wellbore, one of ordinary skill in the art will recognize that onshore, or land-based, applications are substantially similar in configuration and function with respect to those components necessary for MPD and conventional well control operations. As such, the description that follows applies with equal force to land-based drilling systems that include MPD and conventional well control capabilities.

Drilling system 100 includes a drilling rig 101, in this instance, a semi-submersible-type of drilling rig disposed in a body of water 102, that includes various equipment configured to drill a subsea wellbore 106 below the seafloor 104 to recover hydrocarbons disposed therein. One of ordinary skill in the art will appreciate that the type or kind of drilling rig may vary based on an application. In deepwater applications, the seafloor 104 may be more than 1,000 feet below the water's surface 102. In ultra-deepwater applications, the seafloor 104 may be 5,000 feet or more below the water's surface 102. Drilling system 100 may include an MPD system (e.g., annular sealing system 110, annular closing system 115, and return flow spool 120), a marine riser system 125, and a blowout preventer ("BOP") 130, in the offshore example depicted, a subsea BOP ("SSBOP"). One of ordinary skill in the art will recognize that drilling system 100 may include other components such as, for example, a diverter of last resort (not shown), a ball joint (not shown), and a telescopic joint (not shown) that are typically disposed above the MPD system, that are not shown or necessary for understanding the discussion that follows.

For high-specification drilling systems 100, the MPD system typically includes an annular sealing system 110, an annular closing system 115 disposed below annular sealing system 110, and a return flow spool 120 disposed below annular closing system 115. Annular sealing system 110 controllably seals the annulus 108 surrounding drillstring 135 such that it is encapsulated. Annular sealing system 110 may be a Rotating Control Device ("RCD"), an Active Control Device ("ACD"), or any other type or kind of system capable of creating an annular seal such that wellbore pressure may be controlled by the application of surface backpressure. Annular closing system 115 is a redundant system for maintaining the annular seal when annular closing system 110, or components thereof, are being installed, serviced, or replaced. Return flow spool 120 diverts returning fluids from or below the annular seal to MPD choke manifold 145 that directs the returning fluids to the fluids processing systems (e.g., MGS 155 or shale shakers 160) for recycling and reuse. Return flow spool 120 is disposed above, and in fluid communication with, the lower portion of marine riser system 125. One of ordinary skill in the art will recognize that, in lower-specification drilling systems, one or more of the above-noted components may be combined or excluded, but all MPD systems require at least an annular closing system disposed above the BOP 130 and means to controllably divert returning fluids from or below the annular seal.

The lower portion of marine riser system 125 is disposed above, and in fluid communication with, SSBOP 130 disposed on or near seafloor 104. SSBOP 130 may include a lower marine riser package ("LMRP") connector (not labeled), an upper annular preventer 126, a lower annular preventer 127, one or more blind shear rams 128, one or more casing shear rams 129, an upper variable bore ram 131, a lower variable bore ram 132, and a wellhead connector (not labeled). The kill line 124 fluidly connects one or more mud pumps (e.g., 170) disposed on the surface to the SSBOP 130 for injecting fluids below the annular of SSBOP 130 during conventional well control operations described in more detail herein. The choke line 133 fluidly connects an outlet of SSBOP 130 below the annular to a well control choke manifold 134 disposed on the surface to take fluid returns through the choke line 133 during conventional well control operations, also described in more detail herein. SSBOP 130 is disposed above, and in fluid communication with, a wellhead (not independently illustrated) that is disposed above, and in fluid communication with, a wellbore 106 being drilled. A central lumen extends through the conventional MPD system (e.g., annular sealing system 110, annular closing system 115, and return flow spool 120), marine riser system 125, SSBOP 130, wellhead (not independently shown), and into wellbore 106 to facilitate drilling and other operations. Drillstring 135 may be disposed through the central lumen and include, on a distal end, a bottomhole assembly or drill bit 140 configured to drill wellbore 106.

During MPD operations, such as drilling ahead, one or more mud pumps 170 controllably pump drilling fluids (not shown) from mud tank 165 downhole through an interior passageway of drillstring 135. The returning fluids (not shown) return through annulus 108 surrounding drillstring 135 and are controllably diverted by return flow spool 120 via flow line 122 to one or more choke valves (not independently illustrated) of MPD choke manifold 145. The one or more choke valves of MPD choke manifold 145 controllably flow via flow line 147 to flow meter 150 and flow meter 150 flows via flow line 153 to one or more fluids processing systems including, for example, MGS 155 and/or shale shakers 160 for processing prior to returning the processed fluids (not shown) to mud tank 165 for reuse. One or more pressure sensors (not shown) are disposed in the fluid path at different locations to measure pressure of the returning fluids (not shown).

MPD control system 190 may receive pressure sensor data and flow meter 150 data in approximate or near real-time. One of ordinary skill in the art will recognize that approximate or near real-time means very nearly when measured, delayed by measurement, calculation, and/or transmission only, but typically on the order of magnitude of mere fractions of a second or seconds. MPD control system 190 may command one or more choke valves (not independently illustrated) of MPD choke manifold 145 to a desired choke position and/or command the flow rate of mud pumps 170, to achieve a desired pressure. The pressure tight seal on the annulus provided by annular sealing system 110 allows for the precise control of wellbore pressure by manipulation of the choke position of one or more choke valves (not independently illustrated) of MPD choke manifold 145 and the corresponding application of surface backpressure. The choke position of one or more choke valves (not independently illustrated) of MPD choke manifold 145 corresponds to an amount, typically represented as a percentage, that one or more choke valves (not independently illustrated), or MPD choke manifold 145 itself, is open and capable of flowing. If the choke operator wishes to increase wellbore pressure, the choke position of one or more choke valves (not independently illustrated) of MPD choke manifold 145 may be reduced to further restrict fluid flow and apply additional surface backpressure. Similarly, if the choke operator wishes to decrease wellbore pressure, the choke position of one or more choke valves (not independently illustrated) of MPD choke manifold 145 may be increased to increase fluid flow and reduce the amount of applied surface backpressure. As such, MPD systems typically manage wellbore pressure by manipulating the choke position of one or more choke valves (not independently illustrated) of MPD choke manifold 145 and/or the flow rate of mud pumps 170 that inject fluids downhole, based on, at least, pressure sensor data.

In certain applications, a hydraulic model (not independently shown) may be used during MPD and other operations to calculate wellbore pressure, or equivalent circulating density ("ECD"), in approximate or near real-time based on information about the wellbore, equipment, and sensor data including, but not limited to, one or more of well depth, casing depth, internal diameter, inclination angles, water depth, riser diameter, drillstring configuration, geothermal gradient, hydrothermal gradient, real-time drilling parameters such as flow rate, rotation rate, block position (or bit depth), block speed, and mud properties, and surface-based or downhole sensor data that provides actual measurements of various parameters in approximate or near real-time. ECD refers to the effective density exerted by a circulating fluid against the formation that takes into account the pressure drop in the annulus above the point being considered. In this way, ECD may be thought of as the wellbore pressure expressed in terms of mud weight equivalent at a given depth. During drilling operations, the use of ECD is typically preferred over the use of wellbore pressure as it is more descriptive to those operating the rig, however, one or ordinary skill in the art will recognize that they are alternative representations of the same concept and may be used interchangeably with simple conversion. The MPD system may be operated in one of several modes of operation. During drilling and other operations, the MPD system may be used to perform what is referred to as surface backpressure control. In this mode of operation, the choke position of one or more choke valves of the MPD choke manifold 145 may be adjusted, either directly or under automation, to achieve a desired pressure at the MPD choke manifold 145 on the surface. However, the MPD system may also be used to manage downhole pressure. In this mode of operation, the hydraulic model may be used to calculate the pressure and the choke programmable logic device ("PLC") of the MPD control system 190 may determine the choke position of one or more choke valves of the MPD choke manifold 145 to achieve the calculated pressure downhole at depth, taking into account the particulars of the wellbore, equipment, and sensor data.

As noted above, during conventional MPD operations, drilling fluids are pumped through the interior passage of drillstring 135, out of drill bit 140, and then return through annulus 108. The drilling fluids cool and lubricate the drill bit 140, flush cuttings from the bottom of the hole, and counterbalance the formation pressure. The returning fluids are typically processed on the surface and the drilling fluids are separated and recycled for reuse downhole. While the wellbore pressure is effectively managed, under normal operating conditions, the flow out of returning fluids is substantially equal to the flow in of drilling fluids. As such, there is no substantive loss of drilling fluids to the formation and there is no substantive influx of unknown formation fluids into the wellbore. However, due to geological uncertainties, kicks are sometimes taken while drilling ahead. Kicks may be identified by, for example, an imbalance where flow out exceeds flow in for a period of time. When a kick is detected while drilling ahead, the MPD system is the first equipment used to respond. Upon detection of the kick, the MPD control system will start closing the MPD choke manifold 145 to apply further pressure on the well in order to suppress the kicking formation, sometimes referred to as killing the well. Once the wellbore pressure equals or exceeds the pore pressure, the flow out should return to expected levels. When flow out is substantially equal to flow in, a determination is made as to whether the volume of formation fluids taken during the kick requires well control operations. The driller will typically place the total kick volume with the additional pressure required to balance the formation in an operational matrix that determines whether the influx may be circulated out of the well through the MPD system. If the total kick volume exceeds the operational matrix, regulations, technical limitations of equipment, or agreed limits on what may be circulated out through the MPD system, then a decision is made to invoke manually-performed well control operations to circulate the kick out through the well control choke manifold 134 under a closed BOP 130. It is important to recognize that MPD operations are sometimes conducted under automation and the determination to invoke well control operations requires the intervention of a human operator to make the decision to invoke, as well as manually perform, the following well control operations.

Once the decision is made to circulate the kick out via manually-performed well control operations, a first transition, or handover, is performed from MPD operations to conventional well control operations. The mud pumps 170 are shut down, rotation of the drillstring 135 is stopped, and the MPD choke manifold 145 is closed to maintain bottomhole pressure, resulting in the first static condition with respect to fluids within the wellbore 106, meaning there is no circulation of fluids therein during this period of time. This is the first of two times that the wellbore goes static during handovers. Then, the BOP 130 is closed, via annular 126 or 127 or ram 128, 129, 131, or 132, and the choke line 133 is pressured down against the Hydraulic Controlled Remote ("HCR") valve (not shown) of BOP 130, which is then opened, permitting returns to be taken through the choke line 133. The mud pumps 170 are then turned back on and ramped up to start injecting drilling fluids down drillstring 135, while manually adjusting the choke position of the well control choke manifold 134 in an attempt to regulate downhole pressure while taking returns via choke line 133, based on pressure measurements taken at the well control choke manifold 134 or at the BOP 130. The regulation of downhole pressure is manually controlled, typically by a choke operator that adjusts the choke position of the well control choke manifold 134 until the kill line 124 pressure, as measured on the surface, or BOP 130 pressure, as measured underwater by a sensor (not shown), is constant. One of ordinary skill in the art will appreciate that measuring the BOP 130 pressure is preferred, however, in systems that do not have such a sensor (not shown), the kill line 124 pressure may be used. The choke operator rotates a physical wheel or, on electronically controlled choke manifolds, manually presses a position up or down button on an industrial control system (not shown) while monitoring the kill line 124 or BOP 130 pressure to achieve stability.

After establishing the desired mud pump 170 speed, the choke operator manipulates the choke position of one or more valves of the well control choke manifold 134, keeping the standpipe pressure constant, until the kick is circulated out of the wellbore 106. The density of returning fluids is continuously measured at the surface. Whenever the density of returning fluids is substantially equal to the density of injected fluids (i.e., meaning there is no explosive gases remaining in the returning fluids), the kick volume has been circulated out of the wellbore 106 and the well control operation is complete. At this point, a second handover is performed, this time from well control operations to MPD, so that the MPD system may resume drilling ahead. The mud pumps 170 are shut down once again and the well control choke manifold 134 is closed as the mud pumps 170 shut down such that, when the mud pumps 170 are fully stopped the well control choke manifold 134 is fully closed. This represents the second static condition with respect to fluids within the wellbore 106, as circulation has stopped. Downhole pressure is maintained at a constant pressure at the kill line 124 or below the BOP 130 seal while the mud pumps 170 are ramping down. The marine riser 125 is then pressurized to equalize pressure across the BOP 130, then the BOP 130 is opened. The HCR valve (not independently illustrated) is closed after the mud pumps 170 have stopped or after pressure is equalized across the BOP 130, at the driller's discretion. Circulation is then reestablished by starting the mud pumps 170, injecting drilling fluids down drillstring 135, and taking returns via flow line 122 from return flow spool 120. The MPD choke manifold 145 is then re-engaged to manage wellbore 106 pressure during drilling operations, typically under automation.

While MPD operations are usually automated, meaning, the hydraulic model is used to calculate the desired pressure and the MPD control system 190 determines the appropriate choke position of one or more choke valves of the MPD choke manifold 145 to achieve the desired pressure, conventional well control operations are performed manually, including the decision to invoke well control operations. During the first handover, from MPD to conventional well control operations, the mud pumps 170 are stopped and the wellbore 106 goes fluidly static below the BOP 130 for the first time. During the substantive portion of well control operations, the kick volume is manually circulated out of the wellbore 106. Again, during the second handover, from conventional well control operations to MPD, the mud pumps 170 are stopped and the wellbore 106 goes fluidly static for the second time. In both instances, the fluidly static state of the wellbore gives rise to the formation of gels. When the fluids within the wellbore 106 go static, there are solids in the mixture of wellbore fluids and those solids react creating what is referred to in the industry as gels. Gels are undesirable as they tend to create pressure spikes during the start-up of the mud pumps 170, in addition to creating difficulty in transmitting pressure through the well system as is required for precise pressure management inside the wellbore 106. So, every time circulation stops and the wellbore 106 goes static, gels are formed and additional force must be applied to break the gels reaction and reduce friction.

Accordingly, in one or more embodiments of the present invention, safe dynamic handover between MPD and well control operations provides, for the very first time, the ability to automate MPD, well control operations, and transitions therebetween, that maintain the wellbore in a dynamic fluid state at all times that increases the reliability, efficiency, and safety of operations. In the event of a kick, a safe handover from MPD to well control operations is made without ever going static with respect to fluids within the wellbore, unknown formation fluids within the wellbore are circulated out of the wellbore in a safe and efficient manner, and a safe handover from well control operations to MPD is also made without ever going static with respect to fluids within the wellbore. Advantageously, since the wellbore remains dynamic, even during handovers, the formation of gels is prevented, thereby preventing pressure spikes during the start-up of the mud pumps. In addition, pressure transmission is improved, thereby allowing for more precise pressure management during all phases of MPD operations, well control operations, and transitions therebetween.

Figure 2:
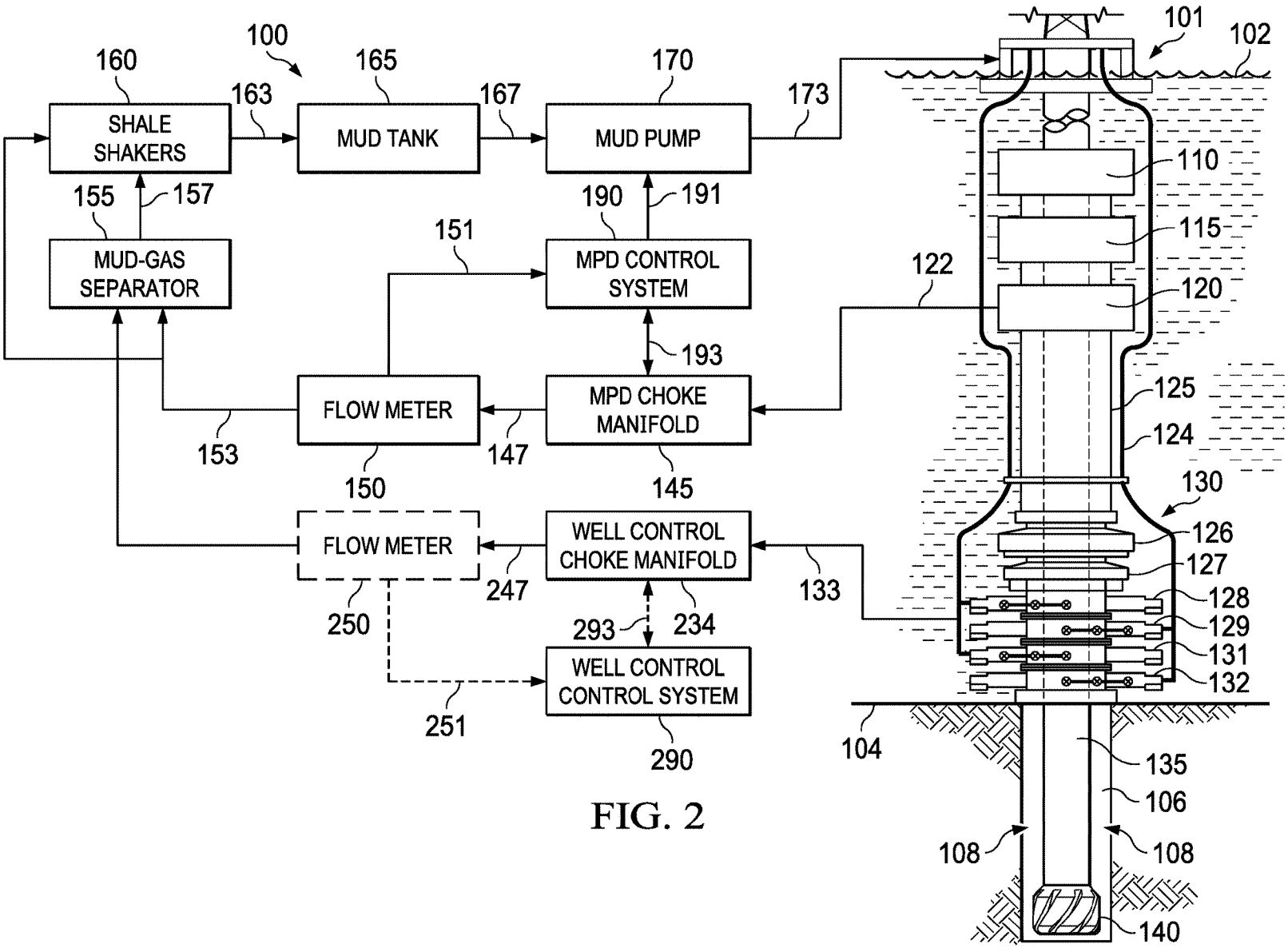
FIG. 2 shows an improved closed-loop hydraulic drilling system for safe dynamic handover between managed pressure drilling and well control in accordance with one or more embodiments of the present invention.

FIG. 2 shows an improved closed-loop hydraulic drilling system 200 with an automated well control choke manifold 234 for safe dynamic handover between MPD and well control operations in accordance with one or more embodiments of the present invention. Safe dynamic handover means a handover or transition between MPD and well control or well control and MPD where the wellbore remains fluidly dynamic due to continuous injection of drilling fluids. For the purposes of illustration, a drilling system 200 for offshore drilling operations is shown. While offshore applications require additional components such as, for example, a marine riser system, to facilitate drilling a subsea wellbore, one of ordinary skill in the art will recognize that onshore, or land-based, applications are substantially similar in configuration and function with respect to those components necessary for MPD and well control operations. As such, the description that follows applies with equal force to land-based drilling systems that include MPD and well control capabilities.

Drilling system 200 may include an automated well control choke manifold 234, an independent well control control system 290, and optionally a downstream flow meter 250 that enable automation of handover and well control operations as discussed in more detail herein. Similar to the conventional well control choke manifold 134 of FIG. 1, automated well control choke manifold 234 may take fluid returns from the choke line 133 below the BOP 130 seal. An optional flow meter 250 may be disposed downstream of automated well control choke manifold 234 and fluidly connect automated well control choke manifold 234 to mud-gas separator 155. Independent well control control system 290 may automatically control the choke position of one or more choke valves of automated well control choke manifold 234 during handovers between managed pressure drilling and well control operations and during well control operations to maintain the wellbore in a dynamic fluid state at all times. In embodiments including optional flow meter 250, flow meter 250 may provide sensor data to the well control control system 290.

Automated well control choke manifold 234 may be substantially similar to the conventional well control choke manifold (e.g., 134 of FIG. 1) in terms of core choke functionality but differ in that it includes an interface that allows for independent control by the well control control system 290. The well control control system 290 and automated well control choke manifold 234 may include connectivity that facilitates control of the choke manifold 234 by well control control system 290. In this way, well control control system 290 may dictate the choke position of automated well control choke manifold 234. For example, software executing on the well control control system 290, or related system, may govern operations of automated well control choke manifold 234 including commanding one or more choke valves of automated well control choke manifold 234 to a desired choke position to achieve a desired surface pressure or wellbore pressure. Assuming for the purpose of discussion, that drilling system 200 is drilling ahead using the MPD system (e.g., annular sealing system 110, annular closing system 115, and return flow spool 120), potentially under automation. Due to geological uncertainties, a kick may be unexpectantly taken. When a kick is detected, the MPD system may be the first equipment used to respond to the contingency. Upon detection of the kick, the MPD control system may start closing one or more choke valves of the MPD choke manifold 145 to apply further pressure on the well in order to suppress the kicking formation. For example, under automation, MPD control system 190 may start closing one or more choke valves of MPD choke manifold 145 until flow out is substantially equal to flow in. Once the wellbore pressure equals or exceeds the pore pressure, the flow out should return to expected levels. When flow out is substantially equal to flow in, a determination may be made as to whether the volume of unknown formation fluids taken during the kick requires well control operations. The driller will typically place the total kick volume with the additional pressure required to balance the formation in an operational matrix to determine if the unknown formation fluids may be circulated out of the well through the MPD system. If the total kick volume exceeds the operational matrix, regulations, technical limitations of equipment, or agreed limits on what may be circulated out through the MPD system, then a decision is made to invoke well control operations.

In certain embodiments, a Dynamic Formation Integrity Test ("DFIT") may be performed to determine the maximum mud pump speed that may be used to circulate out the volume of unknown formation fluids within the wellbore 106. In this way, the MPD system may be used to apply additional surface backpressure into the well while the mud pumps 170 are running. The flow in and flow out may be monitored to identify if the well 106 enters into losses such that flow in exceeds flow out. The result of the DFIT is a determination of the pressure range that the formation holds integrally. The higher the pressure, the greater mud pump 170 speed that may be used so long as choke line 133 friction is not exceeded while doing so. In an ideal situation, the preference is to fully open the fluid path through automated well control choke manifold 234 to shorten the time required to circulate out the kick volume.

At this point, the kick was taken, it was determined that the kick must be circulated out using well control operations, and the MPD system has been used to kill the well. The MPD system is in downhole pressure mode where the hydraulic model is used to calculate downhole pressure. With this information the choke PLC (not independently illustrated) of the MPD control system 190 determines whether the pressure setpoint of the MPD choke manifold 145 on the surface needs to be increased or decreased to achieve the desired downhole pressure, thereby regulating downhole pressure by application of surface backpressure. The drillstring rotation may be stopped, or significantly reduced, then the drillstring may be spaced out, such that the drillstring 135 is moved up or down, typically up since drill bit 140 is likely on the surface of the bottom of the hole 106 when drilling ahead, to ensure that there is no tool joint in the path of the blind shear rams 128 or the pipe rams 129, 131, and 132. Then stop rotation of drillstring 135 and booster. The real-time hydraulic model may calculate the loss of friction in the well 106 and, since the MPD system is in downhole pressure mode, the MPD control system 190 may automatically adjust the choke position of one or more choke valves of the MPD choke manifold 145 to compensate for the change. The injection rate of drilling fluids may be reduced to the maximum flow rate for the automated well control choke manifold 234. If the DFIT indicates that sufficient flow is possible, it may be possible to leave the Pressure While Drilling ("PWD") tool on. It may be simulated before using forward simulations to define the contribution of choke line 133 friction with enough flow rate to keep the PWD tool alive. At this point, the MPD system may be regulating to surface pressure. With the automated well control choke manifold 234 fully closed at this point, the HCR valve (not independently shown) may be opened, which may be verified by a pressure increase in the kill 124 and choke 133 lines. While differences in kill 124 and choke 133 line pressures may be expected due to possible differences in mud weight and temperature between the marine riser 125 and the lines 124 and 133, the differences must make sense and be of the same order of magnitude.

At this point, returns could potentially be taken through both the MPD choke manifold 145 and the automated well control choke manifold 234, and the automated well control choke manifold 234 is regulating to a sensed pressure taken from below the BOP 130 or kill line 124 pressure. However, standard industry practice is to isolate the marine riser 125 from the wellbore 106 for safety reasons. In order to automatically start closing the MPD choke manifold 145 as the automated well control choke manifold 234 opens, a small pressure imbalance is created between the MPD choke manifold 145 and the automated well control choke manifold 234, that causes the MPD control system 190 to automatically close one or more valves of MPD choke manifold 145. For example, the MPD control system 190 may set the pressure setpoint of the MPD choke manifold 145 to a value higher than the pressure setpoint of the automated well control choke manifold 234 by a predetermined amount, such as, for example, 50 pounds per square inch ("psi"). One of ordinary skill in the art will recognize that the predetermined amount may vary based on an application or design. Then verify that the sensed pressure taken from below the BOP 130 or kill line 124 increases until the automated well control choke manifold 234 starts to open as needed to keep the BOP 130 pressure or kill line 124 pressure constant. For example, well control control system 290 starts to open automated well control choke manifold 234 as need to keep BOP 130 or kill line 124 pressure constant. The MPD flow meter 150 will likely see a loss while the optional well control flow meter 250, if included, will display a substantially equivalent gain. When the MPD choke manifold 145 is fully closed, all wellbore 106 returns may flow through the automated well control choke manifold 234. At this point, the BOP 130 may be closed, via annular 126 or 127 or ram 128, 129, 131, or 132. Returning fluids may be routed from the choke line 133 of the BOP 130 to the automated well control choke manifold 234 for delivery to the mud-gas separator 155. Advantageously, the entire process, including drilling ahead with MPD, detecting the kick, handing over from the MPD system to well control, and the performance of well control operations is done with the wellbore remaining in a fluidly dynamic state below BOP 130, with consistent fluid injection. With the marine riser 125 isolated, the MPD control system 190 may monitor for potential gas within the riser 125 and in the event gas is present, it may be circulated out using the MPD system.

Similarly, once the well control operations are complete, the handover from well control operations to the MPD system may be performed without ever going static with respect to wellbore fluids. To transition from well control operations to MPD, the MPD choke manifold 145 may be used to pressurize the marine riser 125 to equalize pressure across the BOP 130. Once equalized, the BOP 130 may be opened and the automated well control choke manifold 234 may be operated in a mode that seeks to manage pressure at the BOP 130. In order to automatically start closing the automated well choke manifold 234 as the MPD choke manifold 145 opens, a small pressure imbalance may be created between the automated well control choke manifold 234 and the MPD choke manifold 145. For example, well control control system 290 may set a pressure setpoint of the automated well control choke manifold 234 to a value higher than the pressure setpoint of the MPD choke manifold 145 by a predetermined amount, such as, for example, 50 psi. One of ordinary skill in the art will recognize that the predetermined amount may vary based on an application or design. Then verify that the sensed pressure taken from below the annular closing system 110 increases until the MPD choke manifold 145 starts to open as needed to keep pressure below the annular closing system 110 constant. For example, MPD control system 190 starts to open MPD choke manifold 145 as need to keep pressure below annular closing system 110 constant. The optional well control flow meter 250, if any, will see a loss while the MPD flow meter 150 will display an equivalent gain during the transition whereby the well control choke manifold 234 closes as the MPD choke manifold 145 opens. When the automated well control choke manifold 234 is fully closed the HCR valve (not independently illustrated) may be closed and all wellbore 106 returns may flow through the MPD choke manifold 145. At this point, MPD operations, including drilling ahead, may be resumed.

Figure 3:
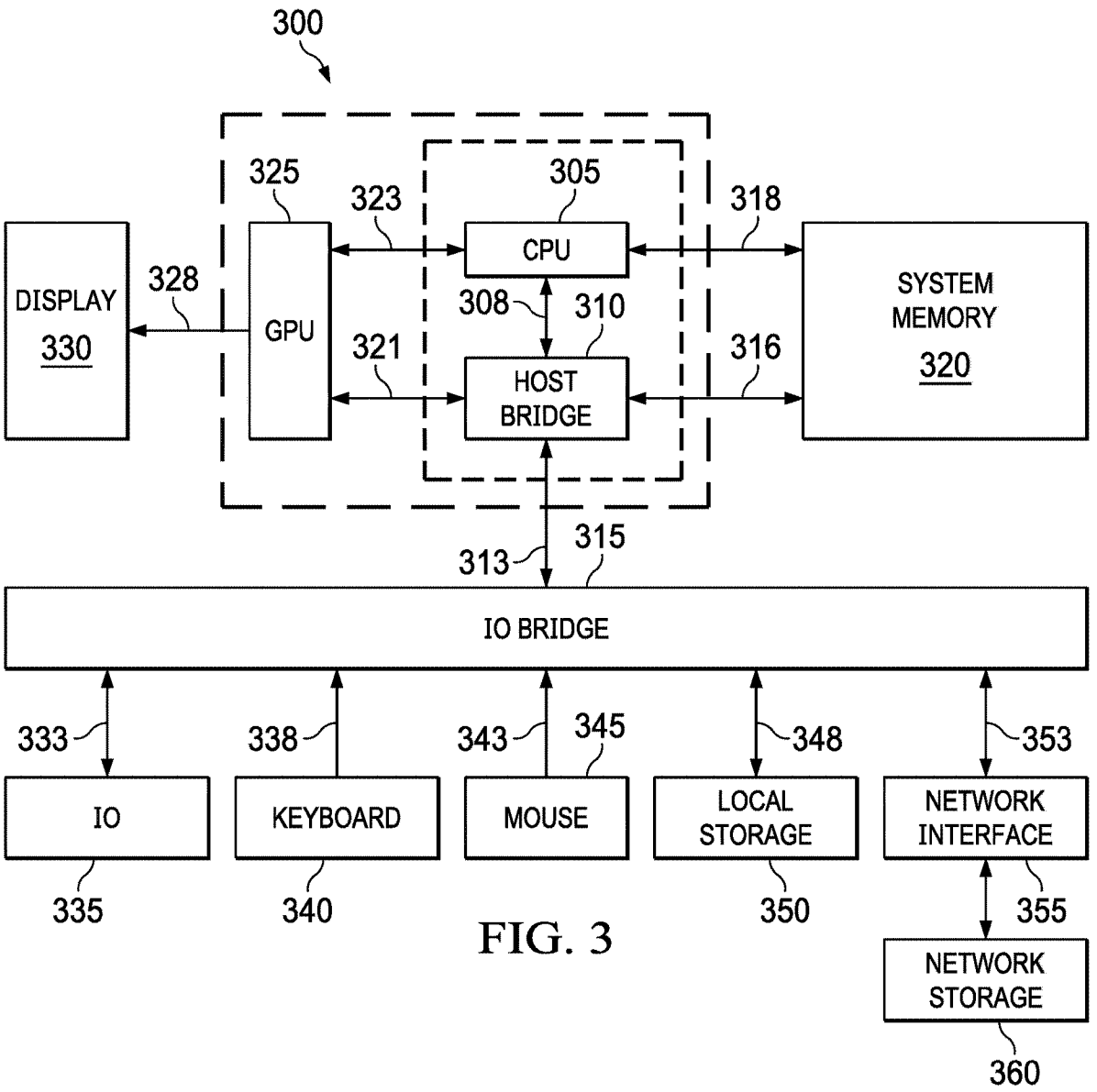
FIG. 3 shows an exemplary control system in accordance with one or more embodiments of the present invention.

One of ordinary skill in the art, having the benefit of this disclosure, will recognize that the above-noted steps may be performed in a different order based on one or more of the operator, driller, or rig procedures. One of ordinary skill in the art will also recognize that the safe dynamic handover between MPD and well control maintains wellbore fluids in a dynamic state. The methods disclosed herein enable the safe transition from MPD to well control and from well control to MPD in a manner that does not require the mud pumps to be stopped, thereby ensuring a fluidly dynamic state in the wellbore that advantageously prevents the formation of gels. FIG. 3 shows an exemplary computer or control system 300 in accordance with one or more embodiments of the present invention. One of ordinary skill in the art will recognize that, as discussed above, a system for safe dynamic handover between MPD and well control (e.g., 200 of FIG. 2) may include a plurality of control systems (e.g., MPD control system 190, well control control system 290, and others not necessarily shown) that function independent of one another from a device perspective, but may optionally work together systemically to achieve the objectives of the safe dynamic handover method disclosed herein. Notwithstanding the above, in certain embodiments, such control systems, or the functions or features they implement, may be integrated, or distributed based on an application or design in accordance with one or more embodiments of the present invention. One of ordinary skill in the art will also recognize that the type or kind of MPD control system 190 and well control control system 290 may vary from one another, and from application to application, based on an application or design in accordance with one or more embodiments of the present invention.

An exemplary computer or control system 300 may include one or more of Central Processing Unit ("CPU") 305, host bridge 310, Input/Output ("IO") bridge 315, Graphics Processing Unit ("GPUs") 325, Application-Specific Integrated Circuit ("ASIC") (not shown), and Programmable Logic Controller ("PLC") (not shown) disposed on one or more printed circuit boards (not shown) that perform computational or logical operations. Each CPU 305, GPU 325, ASIC (not shown), and PLC (not shown) may be a single-core device or a multi-core device. Multi-core devices typically include a plurality of cores (not shown) disposed on the same physical die (not shown) or a plurality of cores (not shown) disposed on multiple die (not shown) that are collectively disposed within the same mechanical package (not shown).

CPU 305 may be a general-purpose computational device that executes software instructions. CPU 305 may include one or more of interface 308 to host bridge 310, interface 318 to system memory 320, and interface 323 to one or more 10 devices, such as, for example, one or more GPUs 325. GPU 325 may serve as a specialized computational device that typically performs graphics functions related to frame buffer manipulation. However, one of ordinary skill in the art will recognize that GPU 325 may be used to perform non-graphics related functions that are computationally intensive. In certain embodiments, GPU 325 may interface 323 directly with CPU 305 (and indirectly interface 318 with system memory 320 through CPU 305). In other embodiments, GPU 325 may interface 321 directly with host bridge 310 (and indirectly interface 316 or 318 with system memory 320 through host bridge 310 or CPU 305 depending on the application or design). In still other embodiments, GPU 325 may directly interface 333 with IO bridge 315 (and indirectly interface 316 or 318 with system memory 320 through host bridge 310 or CPU 305 depending on the application or design). One of ordinary skill in the art will recognize that GPU 325 includes on-board memory as well. In certain embodiments, the functionality of GPU 325 may be integrated, in whole or in part, with CPU 305 and/or host bridge 310.

Host bridge 310 may be an interface device that interfaces between the one or more computational devices and IO bridge 315 and, in some embodiments, system memory 320. Host bridge 310 may include interface 308 to CPU 305, interface 313 to IO bridge 315, for embodiments where CPU 305 does not include interface 318 to system memory 320, interface 316 to system memory 320, and for embodiments where CPU 305 does not include an integrated GPU 325 or interface 323 to GPU 325, interface 321 to GPU 325. The functionality of host bridge 310 may be integrated, in whole or in part, with CPU 305 and/or GPU 325.

IO bridge 315 may be an interface device that interfaces between the one or more computational devices and various IO devices (e.g., 340, 345) and IO expansion, or add-on, devices (not independently illustrated). IO bridge 315 may include interface 313 to host bridge 310, one or more interfaces 333 to one or more IO expansion devices 335, interface 338 to keyboard 340, interface 343 to mouse 345, interface 348 to one or more local storage devices 350, and interface 353 to one or more network interface devices 355. The functionality of IO bridge 315 may be integrated, in whole or in part, with CPU 305, host bridge 310, and/or GPU 325. Each local storage device 350, if any, may be a solid-state memory device, a solid-state memory device array, a hard disk drive, a hard disk drive array, or any other non-transitory computer readable medium. Network interface device 355 may provide one or more network interfaces including any network protocol suitable to facilitate networked communications.

Control system 300 may include one or more network-attached storage devices 360 in addition to, or instead of, one or more local storage devices 350. Each network-attached storage device 360, if any, may be a solid-state memory device, a solid-state memory device array, a hard disk drive, a hard disk drive array, or any other non-transitory computer readable medium. Network-attached storage device 360 may or may not be collocated with control system 300 and may be accessible to control system 300 via one or more network interfaces provided by one or more network interface devices 355.

One of ordinary skill in the art will recognize that control system 300 may be a conventional computing system or an application-specific computing system (not shown) configured for industrial applications. In certain embodiments, an application-specific computing system (not shown) may include one or more ASICs (not shown) PLCs (not shown) that perform one or more specialized functions in a more efficient manner. The one or more ASICs (not shown) may interface directly with CPU 305, host bridge 310, or GPU 325 or interface through IO bridge 315. Alternatively, in other embodiments, an application-specific computing system (not shown) may represent a reduced number of components that are necessary to perform a desired function or functions in an effort to reduce one or more of chip count, printed circuit board footprint, thermal design power, and power consumption. In such embodiments, the one or more ASICs (not shown) and/or PLCs (not shown) may be used instead of one or more of CPU 305, host bridge 310, TO bridge 315, or GPU 325, and may execute software instructions. In such systems, the one or more ASICs (not shown) or PLCs (not shown) may incorporate sufficient functionality to perform certain network, computational, or logical functions in a minimal footprint with substantially fewer component devices.

As such, one of ordinary skill in the art will recognize that CPU 305, host bridge 310, IO bridge 315, GPU 325, ASIC (not shown), or PLC (not shown) or a subset, superset, or combination of functions or features thereof, may be integrated, distributed, or excluded, in whole or in part, based on an application, design, or form factor in accordance with one or more embodiments of the present invention. Thus, the description of control system 300 is merely exemplary and not intended to limit the type, kind, or configuration of component devices that constitute a control system 300 suitable for performing computing operations in accordance with one or more embodiments of the present invention. Notwithstanding the above, one of ordinary skill in the art will recognize that control system 300 may be an industrial, standalone, laptop, desktop, server, blade, or rack mountable system and may vary based on an application or design.

In one or more embodiments of the present invention, a method of safe dynamic handover between managed pressure drilling and well control may include identifying an unintentional influx of unknown formation fluids into a wellbore. One or more valves of the MPD choke manifold may close until the downhole pressure is sufficient to suppress further influx of unknown formation fluids into the wellbore, sometimes referred to as killing the well. After the kick is taken, a determination may be made as to whether the volume of unknown formation fluids and the additional downhole pressure required to suppress further influx exceeds an operational matrix or limit. If so, the kick volume requires circulation out by the well control choke manifold and a safe dynamic handover from MPD to well control may include a first transition that maintains a fluidly dynamic state with respect to wellbore fluids. In certain embodiments, an optional DFIT test may be performed to determine the maximum pump speed that may be used to circulate out the volume of unknown formation fluids within the wellbore, while the formation holds integrally. Then the drillstring may be spaced out to ensure that there is no tool joint in the path of a blind shear ram of the blowout preventer. A pressure setpoint of the MPD choke manifold may be set to a surface backpressure setpoint and a pressure setpoint of the automated well control choke manifold may be set to a sensed pressure taken from below a blowout preventer or a kill line pressure of the blowout preventer. The injection rate of drilling fluids may be reduced to maximize the flow rate through the automated well control choke manifold. A pressure imbalance may be created by setting the pressure setpoint of the MPD choke manifold above the pressure setpoint of the automated well control choke manifold by a predetermined amount, such that the pressure imbalance automatically causes the MPD control system to close the MPD choke manifold as the well control control system opens the automated well control choke manifold. The sensed pressure or kill line pressure may be sensed to verify that it increases until the automated well control choke manifold opens enough such that the blowout preventer pressure or kill line pressure remains constant. Then, after the MPD choke manifold has fully closed, an annular of the blowout preventer may be closed. The HCR valve of the blowout preventer may then be opened to enable flow through the choke line of the blowout preventer. Unknown formation fluids may be diverted from the choke line of the blowout preventer to the automated well control choke manifold for delivery to a mud-gas-separator. During this entire process, the wellbore remains fluidly dynamic due to the continuous, but not necessarily same speed of, injection of drilling fluids. In certain embodiments, a flow meter may be disposed downstream of the automated well control choke manifold. A determination may be made that the unknown formation fluids have been circulated out of the wellbore by a substantial equivalence in the fluid density between flow out and flow in. During the transition to, as well as during, well control operations, the wellbore remains fluidly dynamic. In certain embodiments, including offshore applications, fluids containing gas may be in the marine riser. If there is gas within the now isolated marine riser, the unknown formation fluids may be circulated out of the marine riser using the MPD choke manifold.

Once the unknown formation fluids are safely circulated out of the wellbore and potentially the marine riser in offshore embodiments, a safe dynamic handover from well control to MPD may include a second transition that also maintains a fluidly dynamic state with respect to wellbore fluids. In offshore applications, the marine riser may be pressurized to equalize pressure across the blowout preventer. Continuing, in all applications, the annular of the blowout preventer may be opened. The pressure setpoint of the automated well control choke manifold may be set to the sensed pressure taken from below the blowout preventer or the kill line pressure of the blowout preventer. A second pressure imbalance may be created by setting the pressure setpoint of the automated well control choke manifold above the pressure setpoint of the MPD choke manifold by a second predetermined amount, where the second pressure imbalance automatically causes the well control control system to close the automated well control choke manifold as the MPD control system opens the MPD choke manifold. The second predetermined amount may be the less than, equal to, or more than the predetermined amount used to create the pressure imbalance during the first transition from MPD to well control. Then, the HCR valve of the blowout preventer may be closed after the well control choke manifold has closed. The wellbore remains fluidly dynamic due to continuous, but not necessarily the same rate of, injection of drilling fluids. At this point, the MPD system may be used to drill ahead once again. In certain embodiments, the operation of both MPD and well control operations, including transitions therebetween, may be automated. While a human operator typically makes the decision as to whether to circulate fluids out through the MPD system or the well control system, all other steps may be performed by the MPD control system, well control control system, and potentially a computer executing the hydraulic model. One of ordinary skill in the art will recognize that a non-transitory computer-readable medium comprising software instructions that, when executed by a process, may perform one or more of the above-noted methods in accordance with one or more embodiments of the present invention.

Advantages of one or more embodiments of the present invention may include one or more of the following:

In one or more embodiments of the present invention, safe dynamic handover between MPD and well control provides, for the very first time, the ability to automate MPD, well control operations, and transitions therebetween while maintaining the wellbore in a dynamic fluid state at all times, thereby increasing the reliability, efficiency, and safety of operations.

In one or more embodiments of the present invention, safe dynamic handover between MPD and well control provides, for the very first time, an automated well control choke manifold capable of regulating based on pressure rather than choke position to maintain the wellbore in a dynamic fluid state during transitions between MPD and well control operations.

In one or more embodiments of the present invention, safe dynamic handover between MPD and well control governs transitions from MPD to well control and from well control to MPD, where each transition is fluidly dynamic with respect to fluids within the wellbore, advantageously preventing the formation of gels.

In one or more embodiments of the present invention, safe dynamic handover between MPD and well control ensures that unknown formation fluids within the wellbore are contained and circulated out of the wellbore in a safe and efficient manner, without ever going static with respect to wellbore fluids.

In one or more embodiments of the present invention, safe dynamic handover between MPD and well control prevents the formation of gels, thereby preventing pressure spikes during the start-up of the mud pumps.

In one or more embodiments of the present invention, safe dynamic handover between MPD and well control improves pressure transmission through the well system, thereby allowing for precise pressure management during all phases of MPD, well control operations, and transitions therebetween, while maintaining a fluidly dynamic state within the wellbore.

In one or more embodiments of the present invention, safe dynamic handover between MPD and well control increases the safety of operations by precisely managing pressure during all phases of MPD, well control, and transitions therebetween.

In one or more embodiments of the present invention, safe dynamic handover between MPD and well control maintains a dynamic fluid state with respect to fluids within the wellbore even though rotation has stopped, preventing reactions that form gels that must be forcefully broken to resume MPD operations, such as drilling ahead.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of safe dynamic handover between managed pressure drilling and well control comprising:

setting a pressure setpoint of an MPD choke manifold to a surface backpressure setpoint;

setting a pressure setpoint of an automated well control choke manifold to a sensed pressure taken from below a blowout preventer or a kill line pressure of the blowout preventer;

creating a pressure imbalance by setting the pressure setpoint of the MPD choke manifold above the pressure setpoint of the automated well control choke manifold by a predetermined amount, wherein the pressure imbalance automatically causes an MPD control system to close the MPD choke manifold as a well control control system opens the automated well control choke manifold;

verifying that the sensed pressure or kill line pressure increases until the automated well control choke manifold opens enough such that the blowout preventer pressure or kill line pressure remains constant;

closing the blowout preventer after the MPD choke manifold is closed; and diverting unknown formation fluids from a choke line of the blowout preventer to the automated well control choke manifold for delivery to a mud-gas-separator, wherein the wellbore remains fluidly dynamic due to continuous injection of drilling fluids.

2. The method of claim 1, further comprising:

identifying an unintentional influx of unknown formation fluids into the wellbore.

3. The method of claim 2, further comprising:

closing one or more valves of the MPD choke manifold until downhole pressure is sufficient to suppress further influx of unknown formation fluids into the wellbore.

4. The method of claim 3, further comprising:

determining whether a volume of unknown formation fluids and the downhole pressure sufficient pressure to suppress further influx exceeds an operational limit allowing circulation of the influx through the MPD choke manifold.

5. The method of claim 4, further comprising:

performing a Dynamic Formation Integrity Test to determine a maximum mud pump speed that may be used to circulate out the volume of unknown formation fluids within the wellbore.

6. The method of claim 5, further comprising:

stopping rotation and spacing out a drillstring to ensure there is no tool joint in a path of a blind shear ram or a pipe ram of the blowout preventer.

7. The method of claim 6, further comprising:

stopping booster while the MPD choke manifold compensates for a loss of friction.

8. The method of claim 7, further comprising:

reducing an injection rate of drilling fluids to maximize a flow rate through the automated well control choke manifold.

9. The method of claim 8, further comprising:

opening a Hydraulic Control Remote valve of the blowout preventer that governs flow through the choke line of the blowout preventer.

10. The method of claim 9, further comprising:

fully closing the MPD choke manifold.

11. The method of claim 1, further comprising:

monitoring for potential gas within an isolated marine riser.

12. The method of claim 11, further comprising:

if there is gas within the isolated marine riser, circulating fluids out of the marine riser using the MPD choke manifold.

13. The method of claim 1, further comprising:

monitoring a flow rate of returning fluids downstream from the well control choke manifold.

14. The method of claim 1, further comprising:

determining that the volume of unknown formation fluids have been circulated out of the wellbore by a substantial equivalence in fluid density between flow out and flow in.

15. The method of claim 1, further comprising:

pressurizing a marine riser to equalize pressure across the blowout preventer;

opening the blowout preventer;

setting the pressure setpoint of the automated well control choke manifold to the sensed pressure taken from below the blowout preventer or the kill line pressure of the blowout preventer;

creating a second pressure imbalance by setting the pressure setpoint of the automated well control choke manifold above the pressure setpoint of the MPD choke manifold by a second predetermined amount, wherein the second pressure imbalance automatically causes the well control control system to close the automated well control choke manifold as the MPD control system opens the MPD choke manifold; and closing a Hydraulic Controlled Remote valve of the blowout preventer after the well control choke manifold is closed, wherein the wellbore remains fluidly dynamic due to continuous injection of drilling fluids.

16. The method of claim 1, further comprising:

opening the blowout preventer;

setting the pressure setpoint of the automated well control choke manifold to the sensed pressure taken from below the blowout preventer or the kill line pressure of the blowout preventer;

creating a second pressure imbalance by setting the pressure setpoint of the automated well control choke manifold above the pressure setpoint of the MPD choke manifold by a second predetermined amount, wherein the second pressure imbalance automatically causes the well control control system to close the automated well control choke manifold as the MPD control system opens the MPD choke manifold, closing a Hydraulic Controlled Remote valve of the blowout preventer after the well control manifold is closed, wherein the wellbore remains fluidly dynamic due to continuous injection of drilling fluids.

17. A non-transitory computer-readable medium comprising software instructions that, when executed by a processor, perform a method of safe dynamic handover between managed pressure drilling and well control comprising:

setting a pressure setpoint of an MPD choke manifold to a surface backpressure setpoint;

setting a pressure setpoint of an automated well control choke manifold to a sensed pressure taken from below a blowout preventer or a kill line pressure of the blowout preventer;

creating a pressure imbalance by setting the pressure setpoint of the MPD choke manifold above the pressure setpoint of the automated well control choke manifold by a predetermined amount, wherein the pressure imbalance automatically causes an MPD control system to close the MPD choke manifold as a well control control system opens the automated well control choke manifold;

verifying that the sensed pressure or kill line pressure increases until the automated well control choke manifold opens enough such that the blowout preventer pressure or kill line pressure remains constant;

closing the blowout preventer after the MPD choke manifold is closed; and diverting unknown formation fluids from a choke line of the blowout preventer to the automated well control choke manifold for delivery to a mud-gas-separator, wherein the wellbore remains fluidly dynamic due to continuous injection of drilling fluids.

18. The non-transitory computer-readable medium of claim 17, the method further comprising:

identifying an unintentional influx of unknown formation fluids into the wellbore.

19. The non-transitory computer-readable medium of claim 18, the method further comprising:

closing one or more valves of the managed pressure drilling choke manifold until downhole pressure is sufficient to suppress further influx of unknown formation fluids into the wellbore.

20. The non-transitory computer-readable medium of claim 19, the method further comprising:

determining whether a volume of unknown formation fluids and the downhole pressure sufficient pressure to suppress further influx exceeds an operational limit allowing circulation of the influx through the MPD choke manifold.

21. The non-transitory computer-readable medium of claim 20, the method further comprising:

performing a Dynamic Formation Integrity Test to determine a maximum mud pump speed that may be used to circulate out the volume of unknown formation fluids within the wellbore.

22. The non-transitory computer-readable medium of claim 21, the method further comprising:

stopping rotation and spacing out a drillstring to ensure there is no tool joint in a path of a blind shear ram or a pipe ram of the blowout preventer.

23. The non-transitory computer-readable medium of claim 22, the method further comprising:

stopping booster while the MPD choke manifold compensates for a loss of friction.

24. The non-transitory computer-readable medium of claim 23, the method further comprising:

reducing an injection rate of drilling fluids to maximize a flow rate through the automated well control choke manifold.

25. The non-transitory computer-readable medium of claim 24, the method further comprising:

opening a Hydraulic Control Remote valve of the blowout preventer that governs flow through the choke line of the blowout preventer.

26. The non-transitory computer-readable medium of claim 25, the method further comprising:

fully closing the MPD choke manifold.

27. The non-transitory computer-readable medium of claim 17, the method further comprising:

monitoring for potential gas within an isolated marine riser.

28. The non-transitory computer-readable medium of claim 27, the method further comprising:

if there is gas within the isolated marine riser, circulating the fluids out of the marine riser using the MPD choke manifold.

29. The non-transitory computer-readable medium of claim 17, the method further comprising:

monitoring a flow rate of returning fluids downstream from the well control choke manifold.

30. The non-transitory computer-readable medium of claim 17, the method further comprising:

determining that the volume of unknown formation fluids have been circulated out of the wellbore by a substantial equivalence in fluid density between flow out and flow in.

31. The non-transitory computer-readable medium of claim 17, the method further comprising:

pressurizing a marine riser to equalize pressure across the blowout preventer;

opening the blowout preventer;

setting the pressure setpoint of the automated well control choke manifold to the sensed pressure taken from below the blowout preventer or the kill line pressure of the blowout preventer;

creating a second pressure imbalance by setting the pressure setpoint of the automated well control choke manifold above the pressure setpoint of the MPD choke manifold by a second predetermined amount, wherein the second pressure imbalance automatically causes the well control control system to close the automated well control choke manifold as the MPD control system opens the MPD choke manifold; and closing a Hydraulic Controlled Remote valve of the blowout preventer after the well control choke manifold is closed, wherein the wellbore remains fluidly dynamic due to continuous injection of drilling fluids.

32. The non-transitory computer-readable medium of claim 17, the method further comprising:

opening the blowout preventer;

setting the pressure setpoint of the automated well control choke manifold to the sensed pressure taken from below the blowout preventer or the kill line pressure of the blowout preventer;

creating a second pressure imbalance by setting the pressure setpoint of the automated well control choke manifold above the pressure setpoint of the MPD choke manifold by a second predetermined amount, wherein the second pressure imbalance automatically causes the well control control system to close the automated well control choke manifold as the MPD control system opens the MPD choke manifold; and closing a Hydraulic Controlled Remote valve of the blowout preventer after the well control choke manifold is closed, wherein the wellbore remains fluidly dynamic due to continuous injection of drilling fluids.

* * * * *